US007469800B2

(12) United States Patent
Elstone, Sr. et al.

(10) Patent No.: US 7,469,800 B2
(45) Date of Patent: Dec. 30, 2008

(54) FUEL BLADDER CONTAINER

(76) Inventors: Paul J. Elstone, Sr., 420 Main St., Medford, NJ (US) 08055; Daniel L. O'Connor, 3007A Heatherstone Ct., Mt. Laurel, NJ (US) 08054

( * ) Notice: Subject to any disclaimer, the term of this patent is extended or adjusted under 35 U.S.C. 154(b) by 750 days.

(21) Appl. No.: 11/128,487

(22) Filed: May 13, 2005

(65) Prior Publication Data

US 2005/0211738 A1 Sep. 29, 2005

Related U.S. Application Data

(62) Division of application No. 10/378,382, filed on Mar. 3, 2003, now Pat. No. 6,929,160.

(51) Int. Cl.
*B67B 7/00* (2006.01)

(52) U.S. Cl. ..... 222/1; 222/105; 206/386

(58) Field of Classification Search ..... 222/1, 222/100, 105–107; 206/368, 505, 596–600; 220/560.07–560.14, 495, 1; 229/117.34
See application file for complete search history.

(56) References Cited

U.S. PATENT DOCUMENTS 3,448,897 A * 6/1969 Sterling ..... 222/105

FOREIGN PATENT DOCUMENTS

JP 8-164991 * 6/1996 ..... 222/105
JP 2001-225893 * 8/2001 ..... 220/105

* cited by examiner

*Primary Examiner*—Lien T Ngo
(74) *Attorney, Agent, or Firm*—Walter J. Tencza, Jr.

(57) ABSTRACT

An apparatus for holding a fuel bladder is disclosed. The apparatus may include a lid, and a container body. The container body may include first and second hatch doors for accessing fuel in the fuel bladder. The lid may include one or more tie downs, which allow the apparatus to be tied down to an aircraft pallet. One or more devices may be provided for securing the lid to the container body. The container body may include first, second, third, and fourth channels fixed thereto for the use of a forklift device. The apparatus may be further comprised of a first device, which can be placed over an opening in the container body exposed by an opened first hatch door. The first device may include a hose, which can be attached to the fuel bladder in order for fuel from the fuel bladder to be supplied through the hose.

19 Claims, 11 Drawing Sheets

FUEL BLADDER CONTAINER

CROSS REFERENCE TO RELATED APPLICATION(S)

This application is a divisional of and claims the priority of U.S. patent application Ser. No. 10/378,382, filed on Mar. 3, 2003 now U.S. Pat. No. 6,929,160, titled "FUEL BLADDER CONTAINER", inventor(s) and applicant(s) Paul J. Elstone, Sr. and Daniel L. O'Connor.

FIELD OF THE INVENTION

This invention relates to improved methods and apparatus concerning protecting fuel bladders.

BACKGROUND OF THE INVENTION

Military agencies currently use a fuel bladder, typically made of rubber, which is used to provide fuel for portable generators. The fuel bladder is prone to tearing and to subsequent leaks. The fuel bladder may be transported by helicopter or airplane. In either case, if the fuel bladder leaks inside the aircraft, there is currently no known prior art way to contain the fuel.

SUMMARY OF THE INVENTION

The present invention, in one or more embodiments, provides an apparatus for holding a fuel bladder. The apparatus may include a lid, and a container body. The container body may include first and second hatch doors for accessing fuel in the fuel bladder. The lid may include one or more tie downs, which allow the apparatus to be tied down to a pallet. One or more devices may be provided for securing the lid to the container body.

The container body may include a bottom having first, second, third, and fourth channels fixed thereto. Each of the channels may be adaptable for the insertion of a fork of a forklift device. The first and second channels may be parallel to each other. The third and fourth channels may be parallel to each other. The first and second channels may be perpendicular to the third and fourth channels.

The apparatus may be further comprised of a first device, which can be placed over an opening in the container body exposed by an opened first hatch door. The first device may include a hose, which can be attached to the fuel bladder in order for fuel from the fuel bladder to be supplied through the hose.

The present invention, in one or more embodiments, provides a method for storing a fuel bladder and for accessing fuel in the fuel bladder comprising the steps of inserting a fuel bladder into a container body, placing a lid over the container body, and accessing the fuel bladder through a first or a second hatch door in the container body.

DETAILED DESCRIPTION OF THE DRAWINGS

Figure 1:
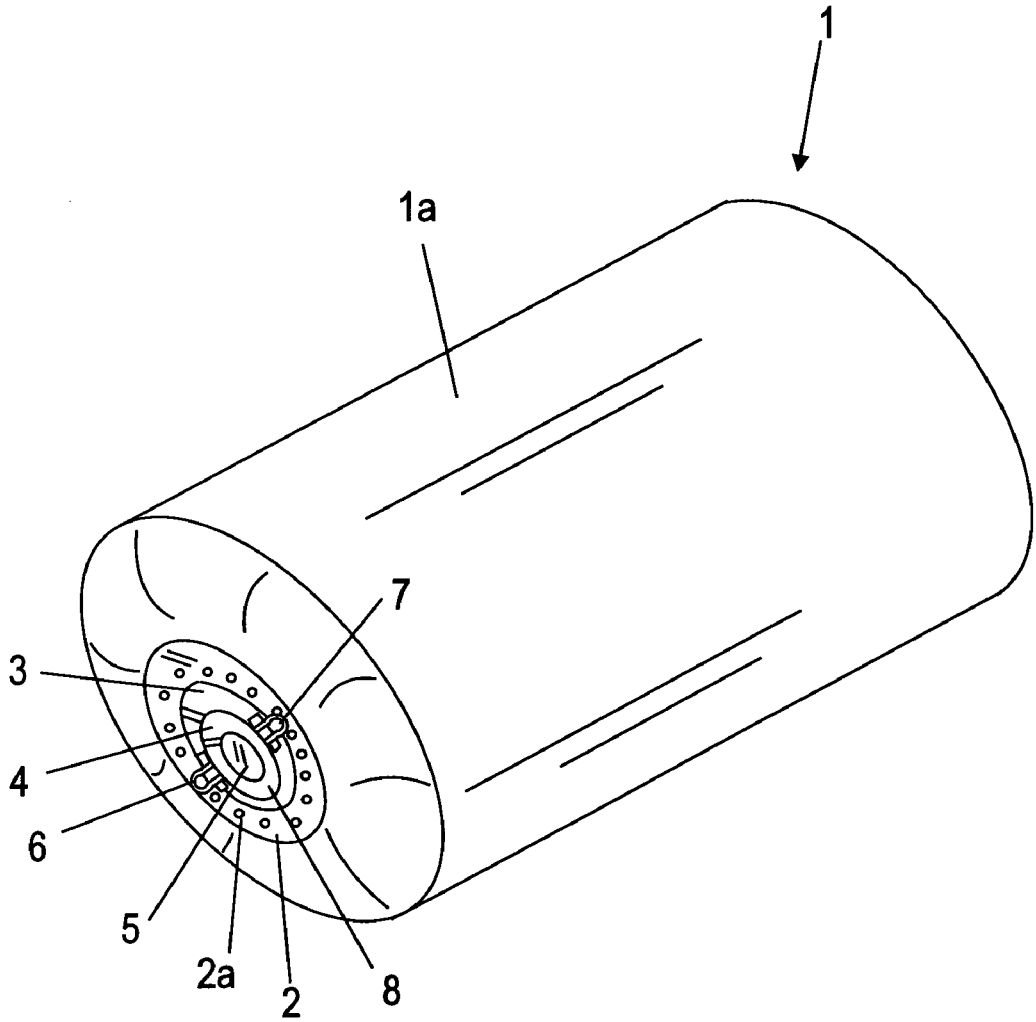
Fig. 1 (Prior Art)
FIG. 1 shows a perspective view of a prior art fuel bladder.

FIG. 1 shows a perspective view of a prior art fuel bladder 1. The fuel bladder 1 may be comprised of a body or substantially cylindrical portion 1*a*. The fuel bladder 1 may also be comprised of a metal rim 2 having a plurality of bolts 2*a*. The metal rim 2 may be attached to a rim 3, which may be attached to a rim 4 which may be attached to a cap 5. The rim 4 may be the outer surface of a pipe through which fuel in the fuel bladder 1 can be allowed to escape, when the cap 5 is taken off. The fuel bladder 1 may be provided with handles 6 and 7 which can be used to take off the cap 5. After the cap 5 is taken off, a pipe can be connected to the rim 4 and fuel can thus be obtained or accessed from the fuel bladder body 1*a*. The fuel bladder 1 may include portions similar to or the same as rim 2, bolts 2*a*, rim 3, rim 4, cap 5, and handles 6 and 7 on the opposite end of the fuel bladder 1. The fuel bladder is typically filled at one end and fuel is dispersed at the other end.

The body 1*a*, of the fuel bladder 1, is typically made of rubber. The rubber is subject to tearing or deterioration due to ultraviolet light exposure, which causes leakage of fuel from the fuel bladder 1.

Figure 2:
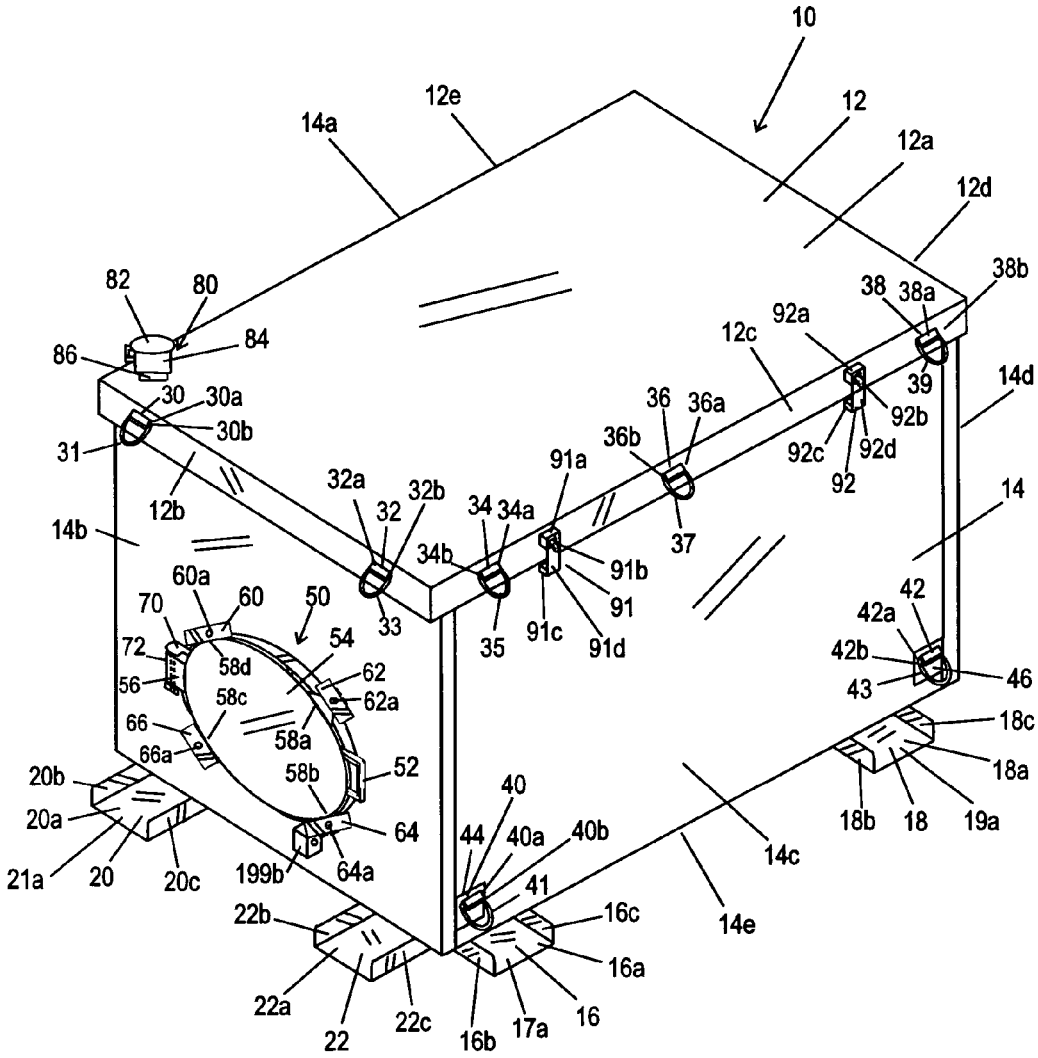
FIG. 2 shows a perspective view of an apparatus in accordance with an embodiment of the present invention, with the apparatus in a closed state.
Figure 3:
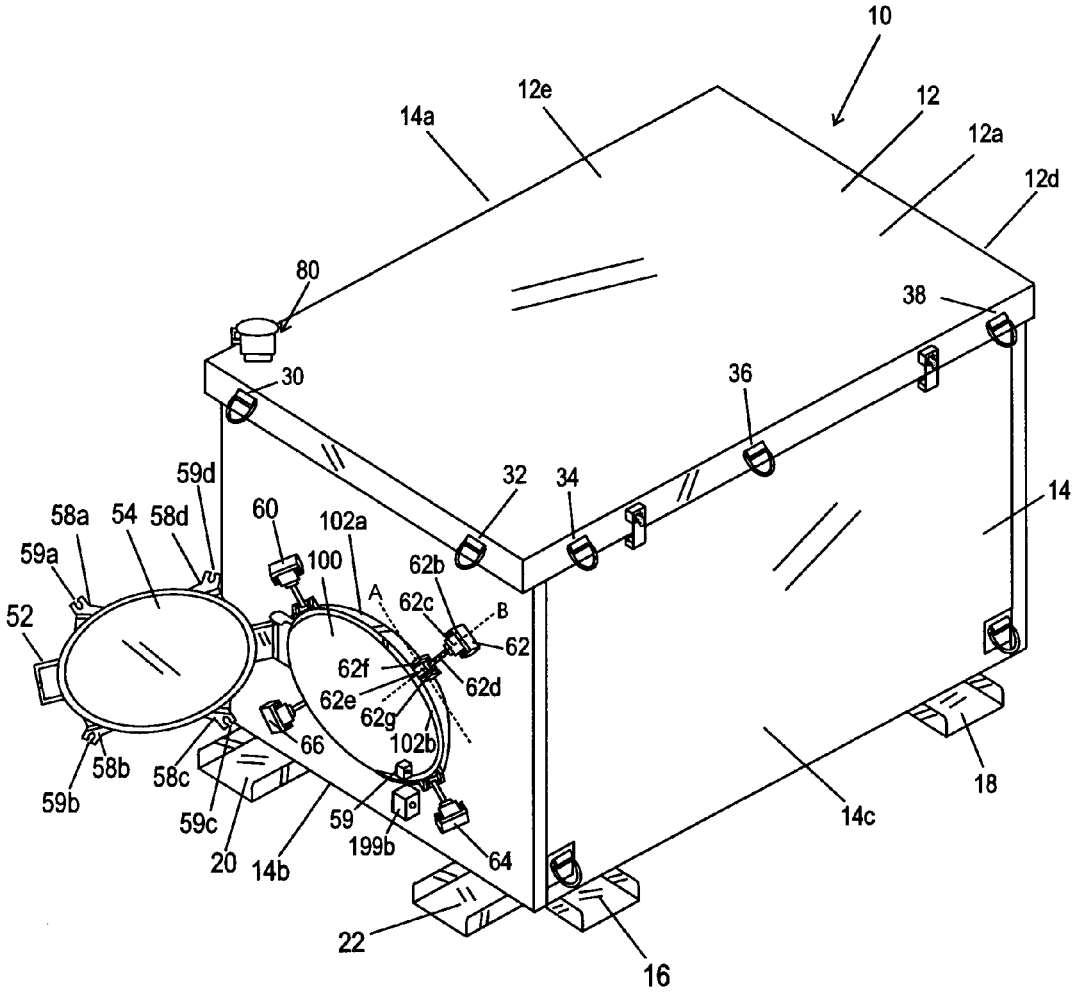
FIG. 3 shows a perspective view of the apparatus of FIG. 2 with the apparatus shown in an open state.
Figure 4:
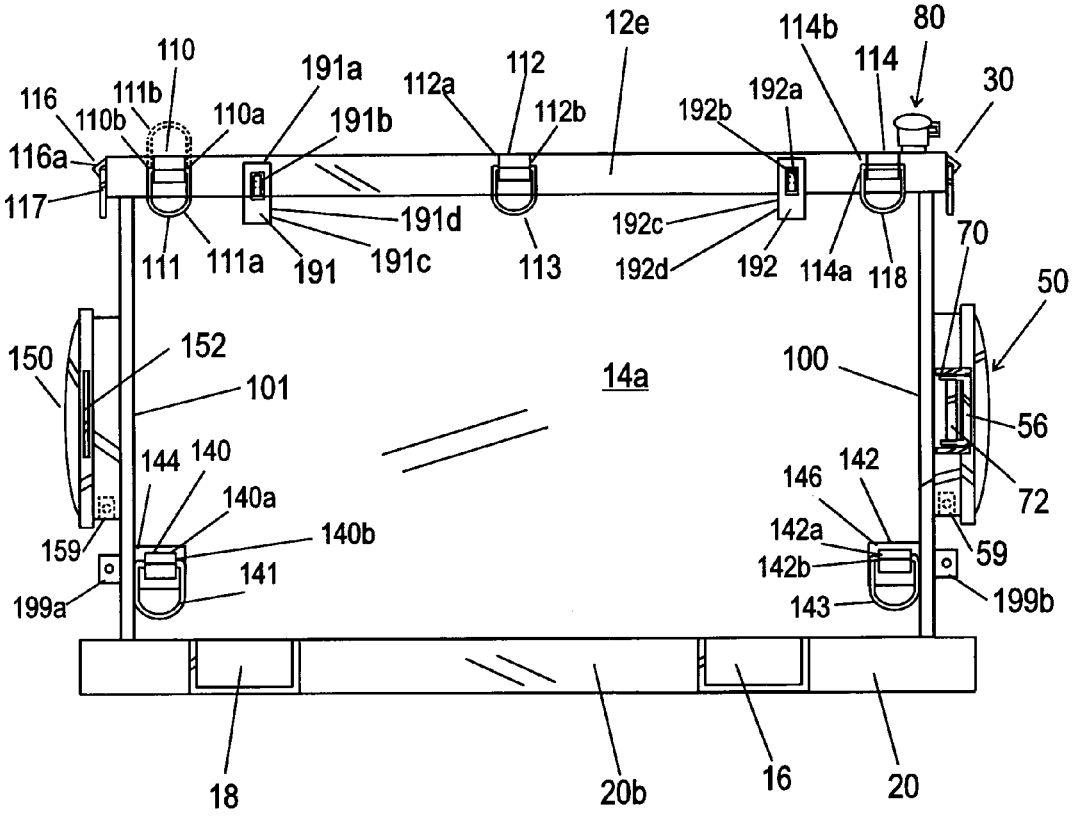
FIG. 4 shows a left side view of the apparatus of FIG. 2, with the apparatus in a closed state.
Figure 5:
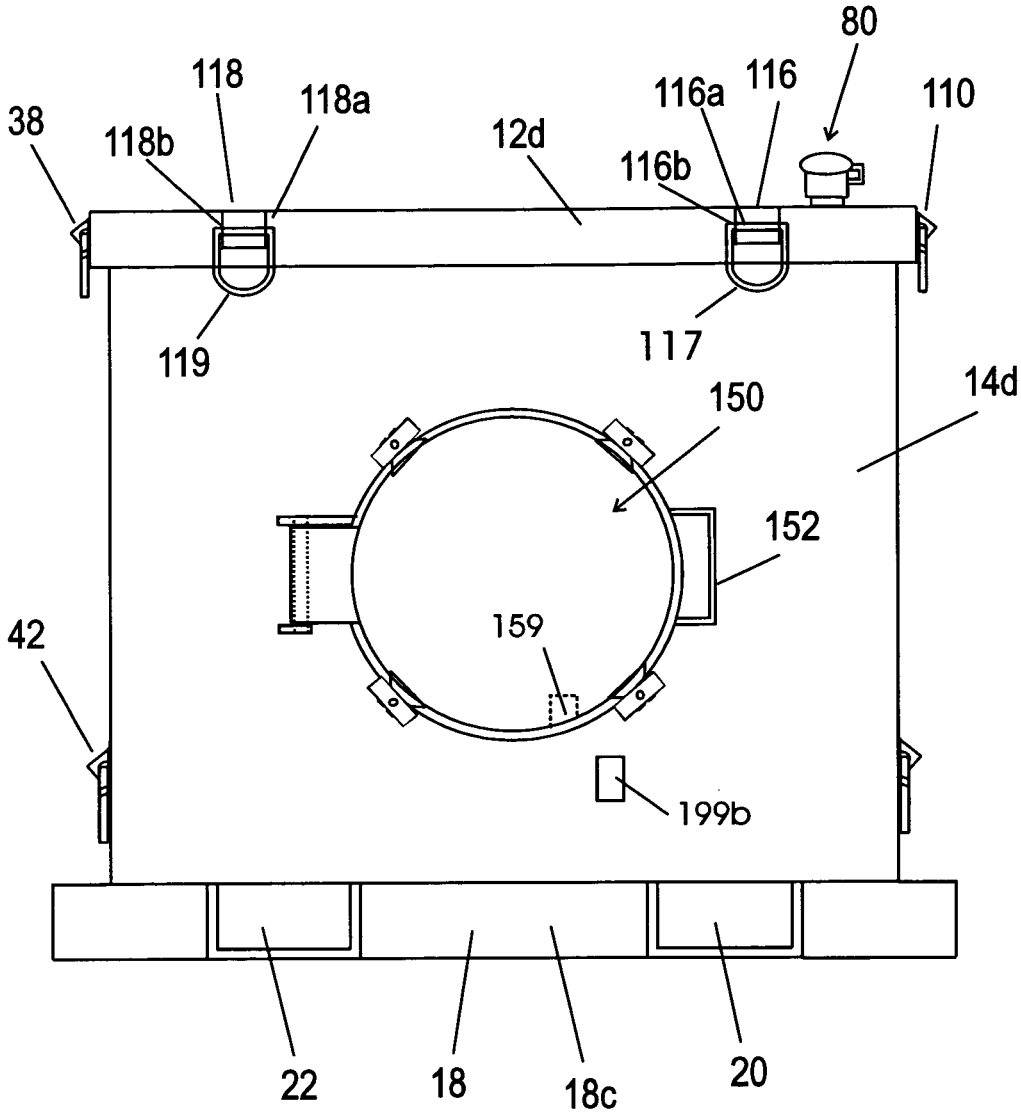
FIG. 5 shows a back view of the apparatus of FIG. 2, with the apparatus in a closed state.
Figure 6:
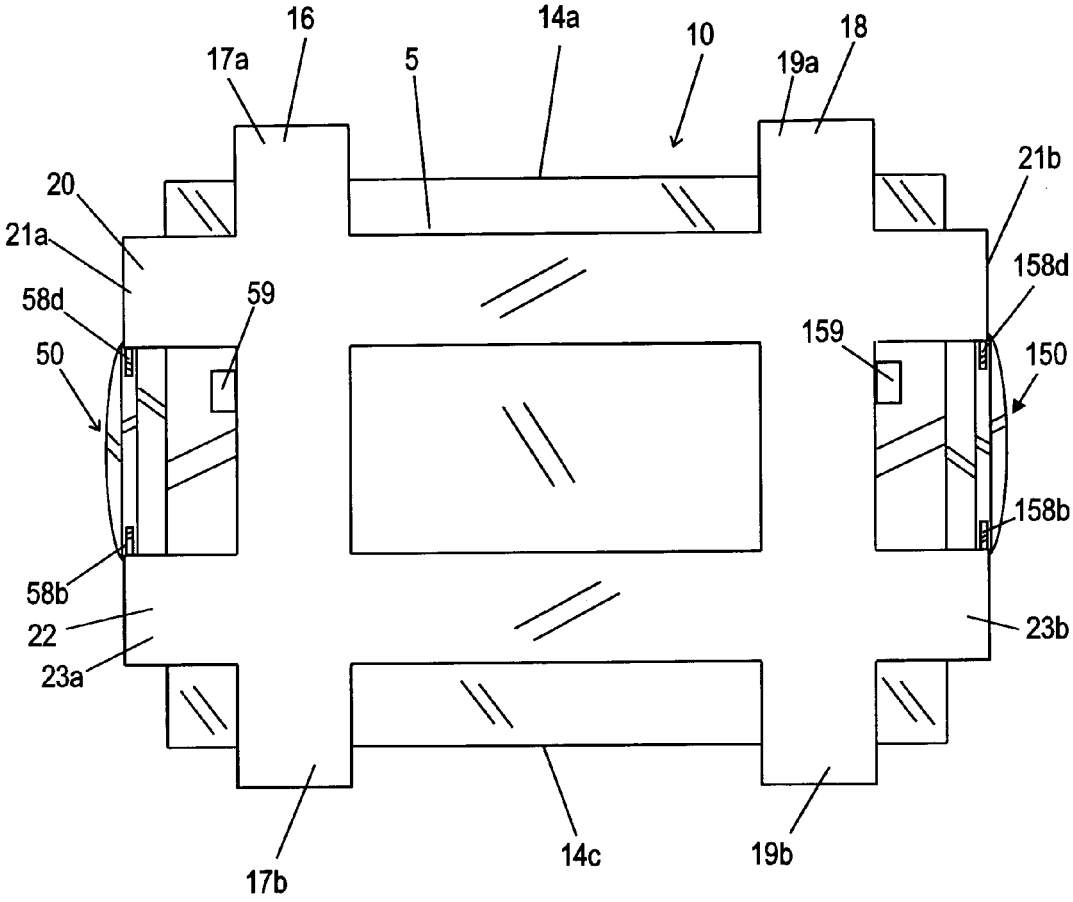
FIG. 6 shows a bottom view of the apparatus of FIG. 2, with the apparatus in a closed state.
Figure 10:
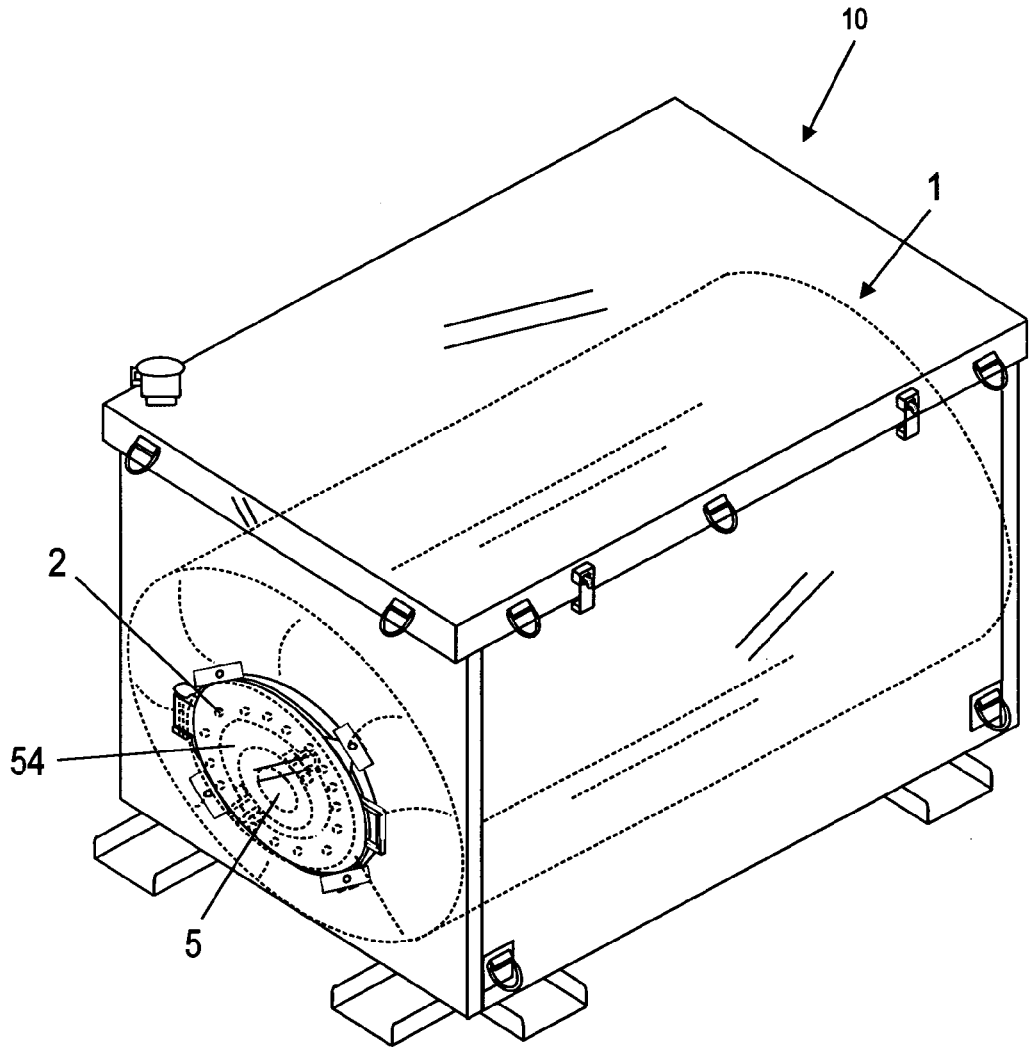
FIG. 10 shows a perspective view of the fuel bladder of FIG. 1 placed in the apparatus of FIG. 2, the fuel bladder is shown in dashed lines.

FIG. 2 shows a perspective view of an apparatus 10 in accordance with an embodiment of the present invention, with the apparatus 10 in a closed state. FIG. 3 shows a perspective view of the apparatus 10 of FIG. 2 with the apparatus 10 in an open state. FIG. 4 shows left side view of the apparatus 10 of FIG. 2, with the apparatus 10 in a closed state. FIG. 5 shows a back view of the apparatus 10 of FIG. 2, with the container 10 in a closed state. FIG. 6 shows a bottom view of the apparatus 10 of FIG. 2, with the apparatus 10 in a closed state. FIG. 10 shows the location of the fuel bladder 1 of FIG. 1 when placed in the apparatus 10 of an embodiment of the present invention.

The apparatus 10 includes a lid 12, and a container body 14. The lid 12 includes a top surface 12*a* and sides 12*b*, 12*c*, 12*d*, and 12*e*. The container body 14 includes sides 14*a*, 14*b*, 14*c*, and 14*d* and bottom surface 14*e*. The sides 14*a-d* and bottom surface 14*e* form an open box structure. The lid 12 and container body 14 are typically made of "5052" aluminum but may be made from other materials. A lightweight and strong material, such as aluminum, should be used.

The lid 12 may also include or have attached thereto tie downs 30, 32, 34, 36, and 38 shown in FIG. 2, tie downs 110, 112, and 114 shown in FIG. 4, and tie downs 116 and 118 shown in FIG. 5. Each of the tie downs includes an attachment device and a loop or ring. Tie downs 30, 32, 34, 36, 38, 110, 112, 114, 116, and 118 include attachment devices 30*a*, 32*a*, 34*a*, 36*a*, 38*a*, 110*a*, 112*a*, 114*a*, 116*a*, and 118*a*, respectively. The attachment devices 30*a*, 32*a*, 34*a*, 36*a*, 38*a*, 110*a*, 112*a*, 114*a*, 116*a*, and 118*a* may each be made of steel and may be welded to or integrated with the lid 12. The attachment devices 30*a*, 32*a*, 34*a*, 36*a*, 38*a*, 110*a*, 112*a*, 114*a*, 116*a*, and 118*a* may include channels or bore holes 30*b*, 32*b*, 34*b*, 36*b*, 38*b*, 110*b*, 112*b*, 114*b*, 116*b*, and 118*b*, respectively. Loops or rings 31, 33, 35, 37, 39, 111, 113, 115, 117, and 119 may be inserted through channels 30*b*, 32*b*, 34*b*, 36*b*, 38*b*, 110*b*, 112*b*, 114*b*, 116*b*, and 118*b*, respectively, and thereby connected to the appropriate attachment device and thereby to or with the lid 12. As shown for example for the ring 111 by FIG. 4, each of the loops or rings 31, 33, 35, 37, 39, 111, 113, 115, 117, and 119 can rotate from a lower position to an upper position. For example, the ring 111 can rotate from the lower position identified as 111*a* to the upper position identified as 111*b* and shown by dashed lines.

The lid 12 also includes an inspection port 80, shown in FIG. 2. The inspection port 80 includes portions 82, 84, and 86. The inspection portion 82 can be opened to look inside container body 14 when the lid 12 is secured to the container body 14. The lid 12 includes portions 91*a*, 92*a*, 191*a*, and 192*a* of draw latches 91, 92, 191, and 192, which are used to secure the lid 12 to the container body 14. The portions 91*a*, 92*a*, 191*a*, and 192*a* end in loops 91*b*, 92*b*, 191*b*, and 192*b* through which can be inserted a loop of a combination lock, for example. The draw latch 91 further includes portions 91*c* and 91*d*. The portion 91*c* is fixed to the container body 14. The portion 91*d* is fixed to the portion 91*c*. The portion 91*d* has an opening through which the loop 91*b* is inserted so that the lid 12 can be secured to the container body 14. Similarly the draw latches 92, 191, and 192 include portions 92*c-d*, 191*c-d*, and 192*c-d*, which function similarly to portions 91*c-d*, respectively.

The container body 14 is capable of retaining liquid. The container body 14 typically has a drain, which may be one inch, which allows for controlled discharge of fuel if a fuel bladder, such as fuel bladder 1 of FIG. 1, was to leak inside the apparatus 10. The drain may have quick disconnect fittings to provide a sufficient controlled discharge.

The container body 14 has attached thereto or includes hatch doors 50 and 150 as shown by FIGS. 2-6. The hatch doors 50 and 150 may be identical and therefore only hatch door 50 will be described in detail. Referring to FIG. 2, the hatch door 50 may be connected through a portion or plate 56 to a pin 72. The pin 72 may be connected to a bracket 70. The bracket 70 may be connected to a hatch door rim 102*a* shown in FIG. 3. The hatch door 50 may include a hatch door body 54. Grooved attachment devices 58*a*, 58*b*, 58*c*, and 58*d*, and a handle 52 may be attached or fixed to the hatch door body 54 as shown in FIG. 3. The hatch door body 54 may be made of stainless steel.

Devices 60, 62, 64, and 66 are connected to the hatch door rim 102*a*, as shown in FIG. 3. Device 62 includes a handle portion 62*b*, a knob portion 62*c*, a rod portion 62*d*, a member 62*e*, and extensions 62*f* and 62*g*. The extensions 62*f* and 62*g* are fixed to the hatch door rim 102*a*. The member 62*e* can rotate about axis A shown in FIG. 3, allowing the rod portion 62*d* to be inserted into the groove 59*a* of the grooved attachment device 58*a* when the door 50 is closed as in FIG. 2. The handle portion 62*b* can then be rotated about axis B to tightly screw the rod portion 62*d* into the groove 59*a*. This secures the hatch door 50 onto the hatch door rim 102*a* and onto the side 14*b* of the container body 14. This also closes an opening 100 in the container body 14. The devices 60, 64, and 66 are the same as the device 62 and can be closed in the same manner. Rod portions of devices 60, 66, and 64 are inserted into grooves 59*d*, 59*c*, and 59*b* of grooved attachment devices 58*d*, 58*c*, and 58*b*, respectively, to fix the hatch door 50 to the hatch door rim 102*a*.

A grounding lug 59 is fixed to the hatch door rim 102*a* as shown by FIG. 3. A similar grounding lug 159, whose location is shown by dashed lines in FIG. 4, is fixed to the hatch door rim for the hatch door 150. A grounding lug 199*a* is fixed to the side 14*d* and a grounding lug 199*b* is fixed to the side 14*b* as shown by FIG. 4.

The container body 14 includes tie downs 40 and 42, shown in FIG. 2, and tie downs 140, and 142, shown in FIG. 4, having attachment devices 40*a*, 42*a*, 140*a*, and 142*a*, and channels or bore holes 40*b*, 42*b*, 140*b*, and 142*b* into which rings or loops 41, 43, 141, and 143 are inserted, respectively. The attachment devices 40*a*, 42*a*, 140*a*, and 142*a* are mounted on plates 44, 46, 144, and 146, respectively. The components 142 and 144 can be reinforcing plates used to spread stresses during a helicopter lift of the apparatus 10. The components 40 and 42 may be aluminum angles welded to 142 and 144, respectively, to secure lifting rings 141 and 143, respectively, for a helicopter lift of the apparatus 10.

The container body 14 has connected to its bottom surface 14*e* a forklift grid 5 as shown by FIG. 6. The forklift grid 5 includes channels 16, 18, 20, and 22. The container body 14 is four-way forklift able. For example, one fork of a forklift can be inserted into channel 20 at end 21*a* and one fork of a forklift can be inserted into channel 22 at end 23*a*, shown in FIG. 6, in order to lift up the container body 14. Alternatively, one fork of a forklift can be inserted into channel 20 at end 21*b* and one fork of a forklift can be inserted into channel 22 at end 23*b*, in order to lift up the container body 14. As a third alternative one fork of a forklift can be inserted into channel 16 at end 17*a* and one fork of a forklift can be inserted into channel 18 at end 19*a*, in order to lift up the container body 14. Finally, one fork of a forklift can be inserted into channel 16 at end 17*b* and one fork of a forklift can be inserted into channel 18 at end 19*b* in order to lift up the container body 14.

Figure 7:
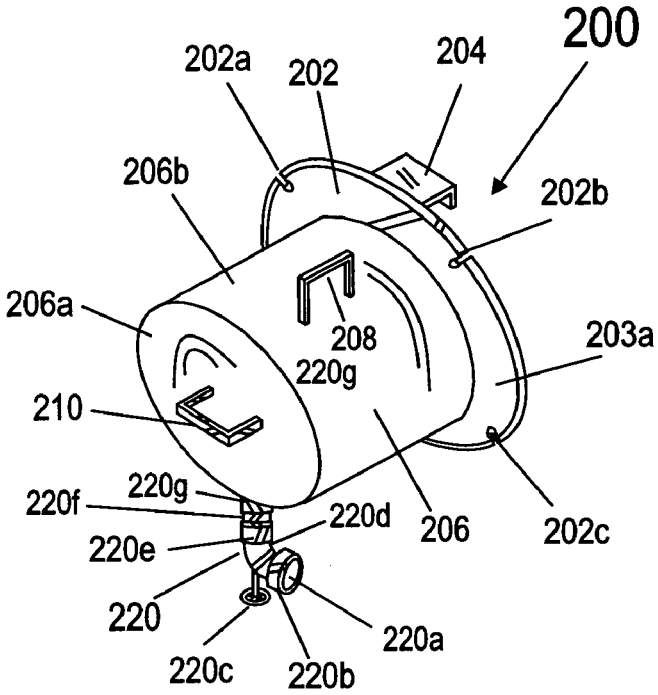
FIG. 7 shows a first perspective view of a device for attaching to the apparatus of FIG. 2.
Figure 8:
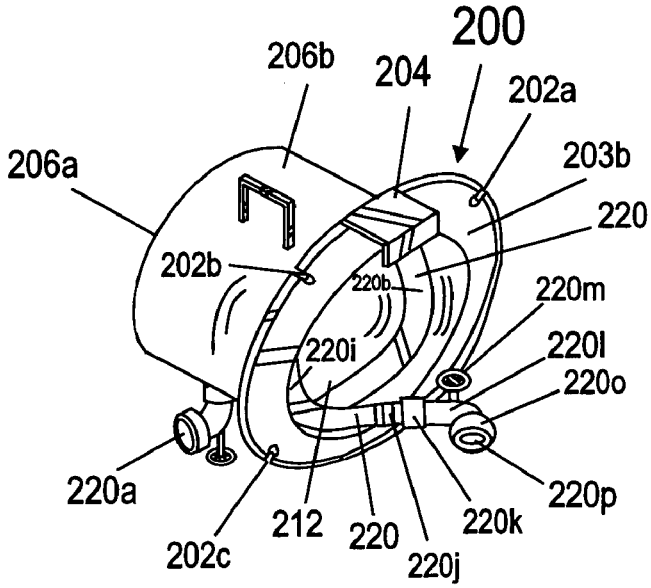
FIG. 8 shows a second perspective view of the device of FIG. 7.
Figure 9:
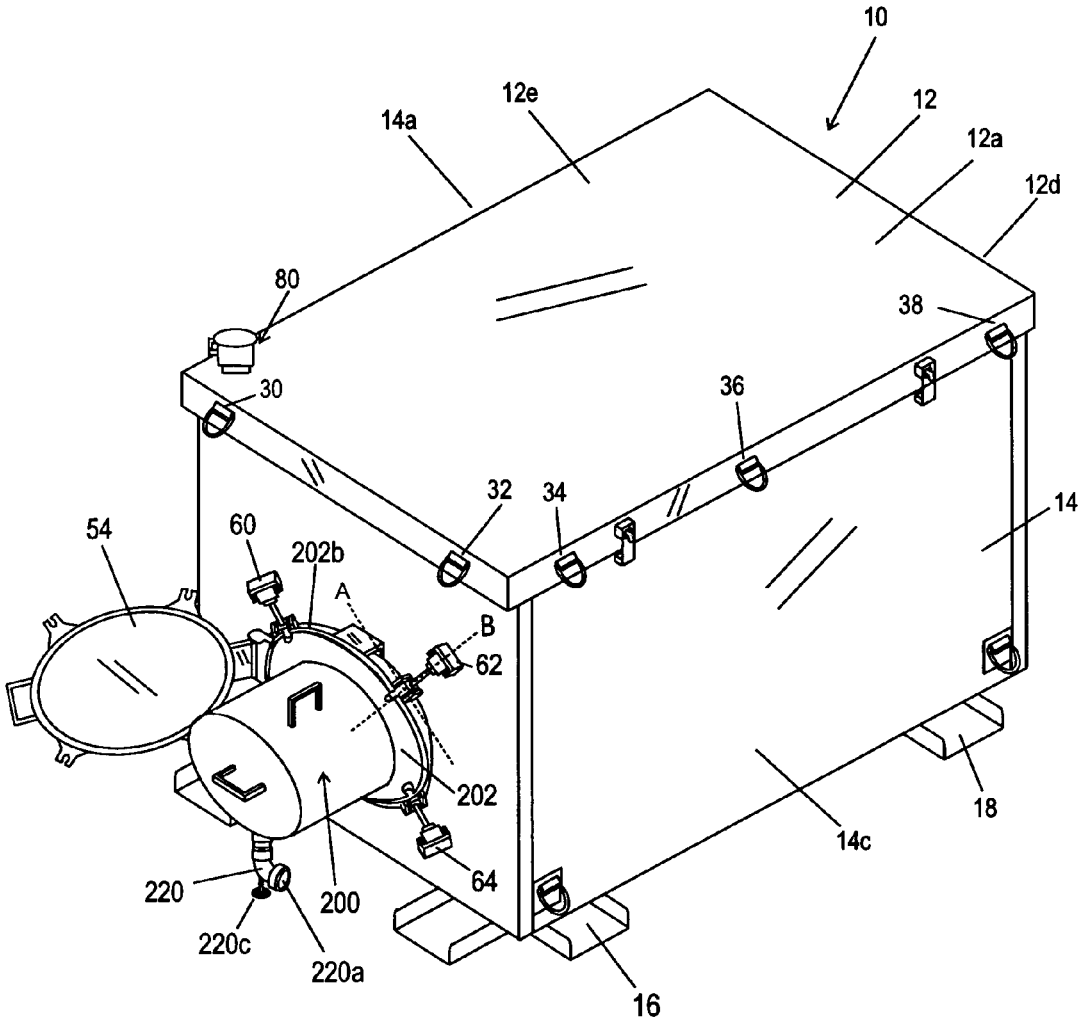
FIG. 9 shows a perspective view of the device of FIG. 7 placed on the apparatus of FIG. 2.

FIG. 7 shows a first perspective view of a device 200 for attaching to the apparatus 10 of FIG. 2. FIG. 8 shows a second perspective view of the device 200 of FIG. 7. FIG. 9 shows a perspective view of the device 200 placed on the apparatus 10 of FIG. 2.

The device 200 is comprised of a rim 202, a bracket 204, a body portion 206, a handle 208, a handle 210, and piping or hose 220. The rim 202 includes four grooves including grooves 202*a*, 202*b*, and 202*c*, and another groove which is not shown but which would be directly across from groove 202*b*. Each of the grooves 202*a*, 202*b*, 202*c*, and a further groove not shown is adapted to be of a size so that a rod portion of a corresponding device of devices 60, 62, 64, and 66 shown in FIG. 3, can fit into its corresponding groove of grooves 202*a*, 202*b*, 202*c* and the further groove not shown.

Similar to the manner in which the door 54 was locked to the rim 102*a*, the device 200 can be locked to the rim 102*a* of the container body 14. For example, the member 62*e* can rotate about axis A shown in FIG. 9, allowing the rod portion 62*d* to be inserted into the groove 202*b* of the rim 202 of the device 200. The handle portion 62*b* can then be rotated about axis B to tightly screw the rod portion 62*d* into the groove 202*b*. In conjunction with the other devices 60, 64, and 66, this secures the device 200 onto the hatch door rim 102*a* and onto the side 14*b* of the container body 14. This also closes the opening 100 in the container body 14. The devices 60, 64, and 66 are the same as the device 62 and can be closed in the same manner as device 62. Rod portions of devices 60, 66, and 64 are inserted into grooves 202*a*, a groove not shown, and 202*c*, respectively, to fix the device 200 to the hatch door rim 102*a*.

The piping or hose 220 of the device 200 includes portion 220*b*, valve 220*c*, portion 220*d*, portions 220*e*, 220*f*, and 220*g* shown in FIG. 7 and 220*h*, 220*i*, 220*j*, 220*k*, 220*l*, valve 220*m*, 220*o*. The hose 220 begins at end 220*a* at which there is an opening and ends at 220*p* at which there is an opening. The hose 220 may be actually one pipe with a valve 220*c* at one end and a valve 220*m* at another end. The hose 220 may a hose with a two inch internal diameter.

In operation, an individual would first place the fuel bladder 1 into the container body 14 as shown in FIG. 10. The individual would next open up the hatch door 50, assuming the hatch door 50 is not already opened. The individual would then take off the cap 5 of the fuel bladder 1 using the devices 6 and 7. Assuming that device 200 of FIGS. 7 and 8 is going to be used, the individual would next couple the end 220*p*, shown in FIG. 8 of the hose 220 to the pipe 4 of the fuel bladder 1. The individual may open the valve 220*m* at the entrance to the device 200, while leaving the valve 220*c* at the exit of the device 200 closed. Next, the device 200 would be attached to the container body 14 by inserting rod portions of devices 60, 62, 64, and 66 into grooves 202*a*, 202*b*, 202*c*, and another groove not shown and tightening devices 60, 62, 64, and 66 in the appropriate groove. Finally the end 220*a* of the hose 220 can be attached to a generator device for generating electricity. When the end 220*a* is secured to the generator device the valve 220*c* may be opened allowing access to fuel in the fuel bladder.

The second hatch door 150 typically has a hatch door opening 101, which is similar to the hatch door opening 100 for the hatch door 50. A second device similar to the device 200 can be attached to the hatch door opening 101 corresponding to the second hatch door.

Fuel bladders, such as fuel bladder 1 of FIG. 1, are often used for military purposes. Fuel bladders may be loaded into an aircraft. If such a fuel bladder were to develop a leak while loaded inside the aircraft, without the present invention, there would be no way to contain the fuel.

The combination bladder 1 and apparatus 10 can be used to supply two generators by the use of two hatch doors, i.e. hatch door 50 and 150. In one embodiment the container body may be provided with a drain with quick disconnect fittings for a controlled discharge if the bladder was to leak insider the container body.

The container body 14 is four-way forklift able as a result of channels 16, 18, 20, and 22, for ease of movement. The tie downs 30, 32, 34, 36, 38, 110, 112, 114, 116, and 118 may be steel tie downs, which may be rated at 5000 lbs. each. The attachment devices or latches 91, 92, 191, and 192, that secure the lid 12 to the container body 14 may be rated at 1000 lbs. each.

The present invention in one or more embodiments provides secondary containment, which prevents a spill in the aircraft. Increased safety is provided, in one or more embodiments with a non-spark container. The fuel bladder 1 may be stored full inside the apparatus 10 minimizing deployment time. The apparatus 10 increases the life of the bladder 1 by shielding it from damaging ultraviolet (UV) rays. The apparatus 10 provides an enclosed system, which greatly improves safety. The apparatus 10 is helicopter sling able.

The hatch openings 100 and 101 may be circular and may have a diameter of twenty inches. The combination of the lid 12 and the container body 14 as shown in FIG. 2, may be eighty four inches long, forty eight inches wide, and forty nine and one half inches high.

The fuel bladder 1 may be a 500-gallon fuel bladder. The lugs 199*a* and 199*b* may be welded to the container body 14 for the grounding of the apparatus 10.

Figure 11:
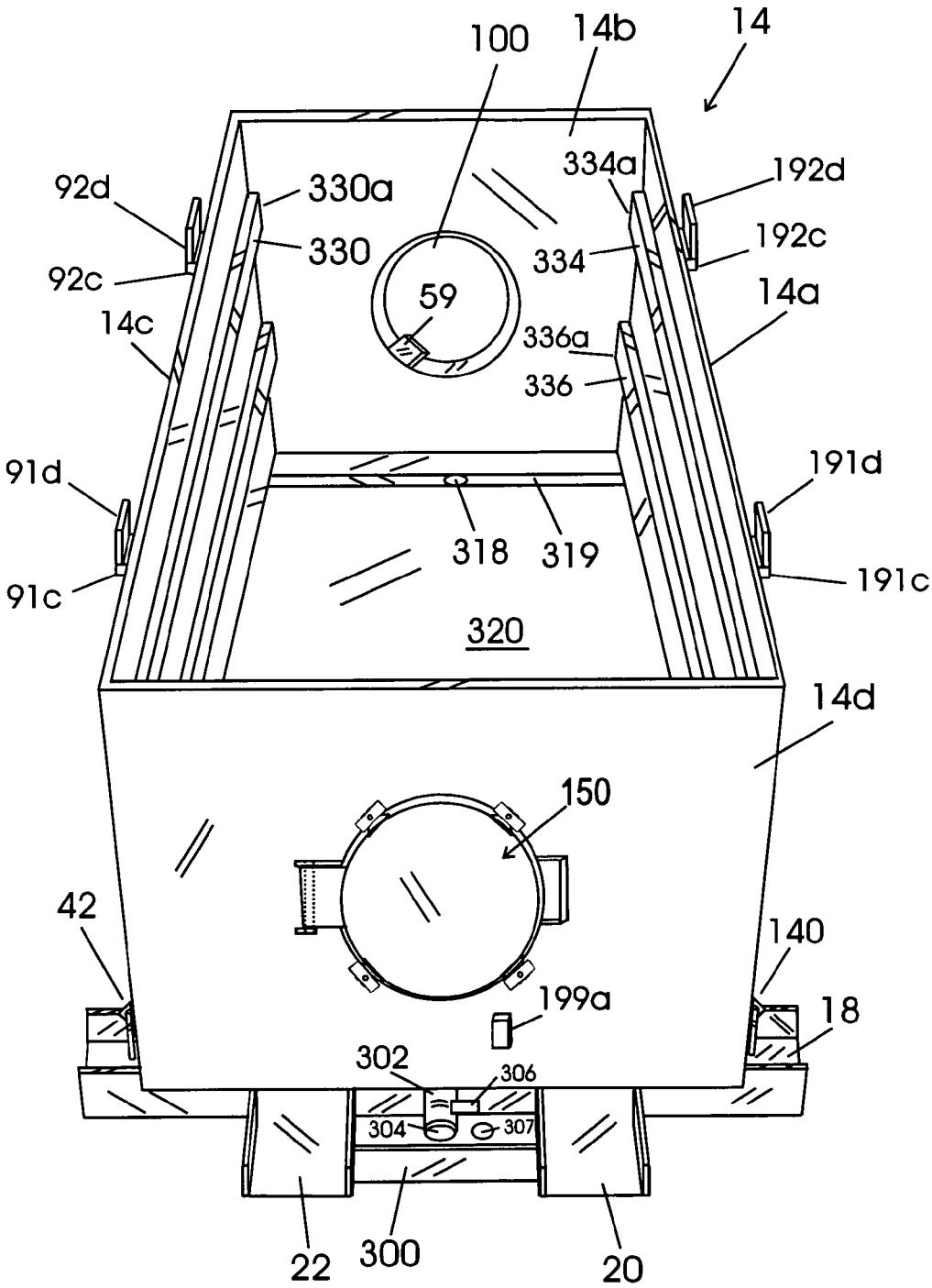
FIG. 11 shows a first perspective view of the inside of the container body of the apparatus of FIG. 2.
Figure 12:
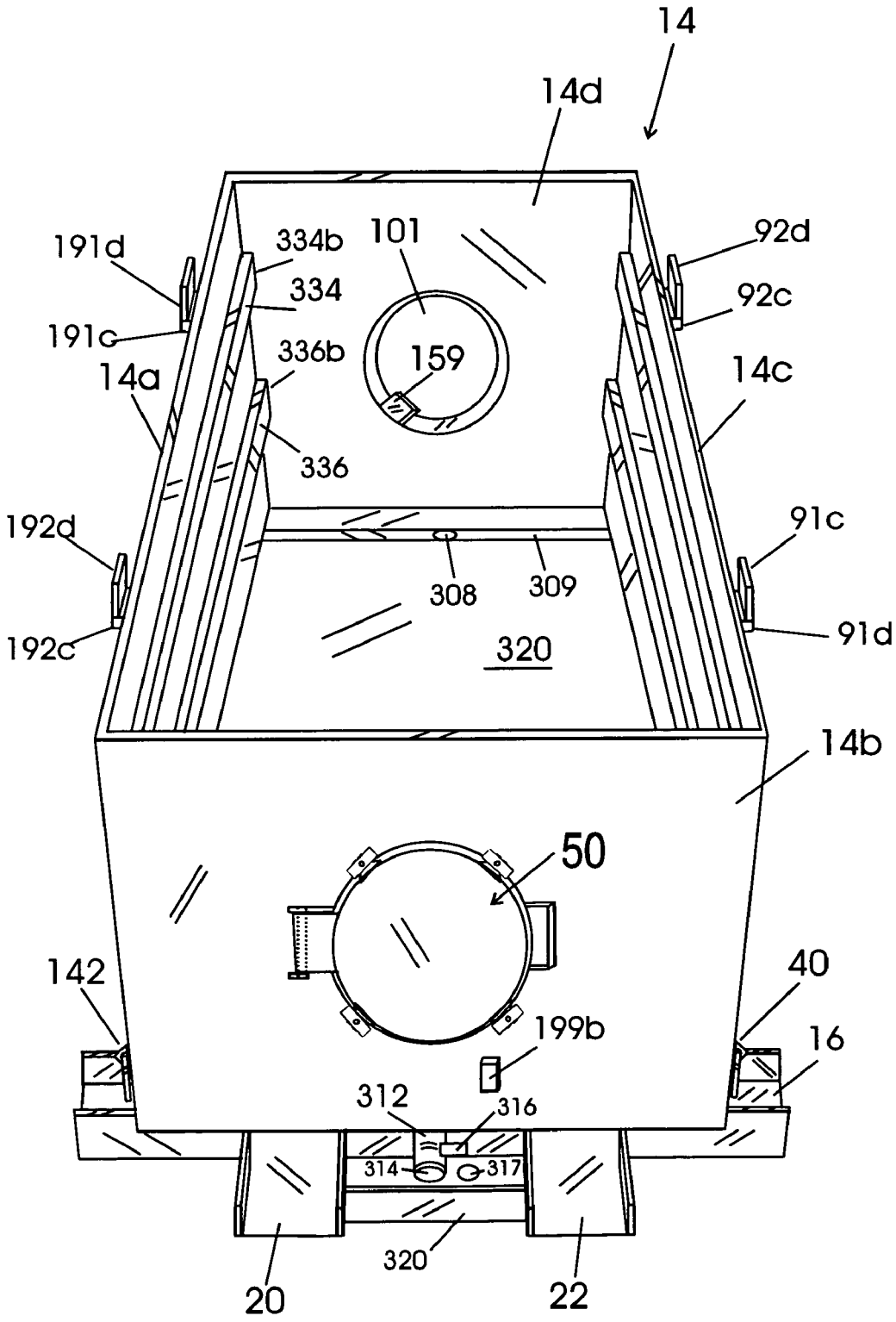
FIG. 12 shows a second perspective view of the inside of the container body of the apparatus of FIG. 2.

FIG. 11 shows a first perspective view of the inside of the container body 14 of the apparatus 10 of FIG. 2. FIG. 12 shows a second perspective view of the inside of the container body 14 of the apparatus 10 of FIG. 2.

The container body 14 includes drain 319 shown in FIG. 11 and drain 309 shown in FIG. 12. The drains 309 and 319 lead to openings 308 and 318 respectively. The openings 308 and 318 may normally be closed or plugged up or in some cases may not be present at all. The openings 308 and 318 lead to hoses or pipes 302, shown in FIG. 11, and 312 shown in FIG. 12, respectively. The hoses or pipes 302 and 312 have openings 304 and 314 respectively. The hoses or pipes 302 and 312 have valve switches or members 306 and 316 respectively. Further openings 307 and 317, respectively may also be provided.

In operation the container body 14 may have a fuel bladder inside it, such as fuel bladder 1, as shown by FIG. 10. If the fuel bladder 1 develops a leak while inside the container body 14, the fuel will simply fall into the container body 14. In one embodiment of the present invention openings 318 and 308 may not be provided and the fuel will simply reside safely in the container body 14. However, in another embodiment of the present invention, the fuel may be slowly drained out of the container body 14 through either or both of openings 308 and 318, then through hoses or pipes 302 and 312 and on openings 304 and 314. The hoses or pipes 302 and 312 may be attached to other hoses or pipes, at the openings 304 and 314, respectively, so that the fuel can be safely delivered to another fuel container. The valve switches 306 and 316 can be turned to allow flow of fuel from the container 14 through openings 304 and 314, respectively, or the valve switches 306 and 316 can be turned to prevent flow of fuel from the container body 14, through openings 304 and 314 respectively.

The container body 14 may include a bottom surface 320 which may slope downwards in the direction of either opening 308 or opening 318 to more easily allow the fuel from the container body 14 to flow out through openings 308 or 318.

The container body 14 may be further comprised of reinforcing members 330, 332, 334, and 336. The reinforcing members 330 and 332 may be fixed, such as by welding, to the side 14*c* of the container body 14. The reinforcing members 334 and 336 may be fixed, such as by welding, to the side 14*a* of the container body 14. The reinforcing member 330 may be fixed at its ends 330*a* and 330*b* to the sides 14*b* and 14*d* of the container body 14. The reinforcing member 332 may be fixed at its ends 332*a* and 332*b* to the sides 14*b* and 14*d*. The reinforcing member 334 may be fixed at its ends 334*a* and 334*b* to the sides 14*b* and 14*d*. The reinforcing member 336 may be fixed at its ends 336*a* and 336*b* to the sides 14*b* and 14*d* of the container body 14.

Also shown in FIGS. 11 and 12 is member 300 and member 320, respectively. The members 300 and 320 are optional. The components 300, 302, 304, 306, 307, 312, 314, 316, 317, and 320 are also optional and these components are not included or shown in FIGS. 1-10.

The apparatus 10 may be designed to withstand certain G (gravitational) forces applied to the apparatus 10 while fully loaded with 5000 lbs. (comprised of for example the fuel bladder 1, and fuel within the fuel bladder 1) tied to an aircraft pallet inside of an aircraft during flight. The apparatus 10 may have all of the corners fabricated with a minimum 1" radius so that there are minimal stresses on the corners of the container. I.e. all of the corners of the apparatus 10, (such as the corner where side 14*c* meets 14*b*, and all the other corners where sides meet) can be rounded off. Also the struts or reinforcing members 334, 336, 330 and 332 can be used to help the sidewalls, i.e. such as sides 14*a* and 14*c*, have the needed strength to meet the G (gravitational) force requirements. The design criteria which may be used allows the apparatus 10 to withstand three G's forward force of 15,000 lbs., 4 G's backward force of 20,000 lbs., 5 G's downward force=25,000 lbs. and 1.5 G's upward force of 7,500 lbs.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. A method for storing a liquid bladder and for accessing liquid in the liquid bladder comprising the steps of inserting the liquid bladder into a container body;

placing a lid over the container body; and accessing the liquid bladder through a first hatch door in the container body;

wherein the first hatch door allows at least some of the liquid in the liquid bladder to be accessed through a first pipe located at a first end of the liquid bladder;

wherein there is a first rim attached to the container body;

wherein the first hatch door can be locked to the first rim or unlocked from the first rim;

wherein the first rim defines a first perimeter of a first opening in a first side of the container body;

and further comprising providing a first device which can be attached to the first rim when the first hatch door is open and unlocked from the first rim, and wherein the first device while attached to the first rim can access at least some of the liquid of the liquid bladder through the first pipe located at the first end of the liquid bladder.

2. The method of claim 1 further comprising accessing the fuel bladder through a second hatch door in the container body;

wherein the second hatch door is opposite the first hatch door.

3. The method of claim 1 further comprising securing the lid to the container body.

4. The method of claim 1 further comprising tying the container body and the lid to an aircraft pallet.

5. The method of claim 1 further comprised of picking up the container body with a forklift.

6. The method of claim 1 further comprising causing liquid to flow from the liquid bladder to the first device through the first pipe, while the first device is attached to the first rim.

7. The method of claim 1 wherein the lid includes one or more tie downs, which allow the lid and the container body to be tied down to an aircraft pallet.

8. The method of claim 1 further comprised of one or more devices for securing the lid to the container body.

9. The method of claim 1 wherein the container body includes a bottom;

wherein one or more channels are fixed to the bottom of the container body; and wherein each of the one or more channels is adaptable for the insertion of a fork of a forklift device.

10. The method of claim 9 wherein first and second channels are fixed to the bottom of the container body, the first and second channels each adaptable for the insertion of the fork of the forklift device.

11. The method of claim 10 wherein the first and second channels are parallel to each other.

12. The method of claim 9 wherein first, second, third, and fourth channels are fixed to the bottom of the container body; and wherein the first, second, third, and fourth channels each adaptable for the insertion of the fork of the forklift device; and wherein the first and second channels are parallel to each other;

wherein the third and fourth channels are parallel to each other; and wherein the first and second channels are perpendicular to the third and fourth channels.

13. The method of claim 1 wherein the liquid is fuel for a generator device for generating electricity.

14. The method of claim 1 wherein the container body includes first, second, third, and fourth sides, and a bottom surface;

and wherein liquid can not leak through the first, second, third, or fourth sides, or the bottom surface.

15. The method of claim 1 wherein the container body includes a second hatch door which allows at least some of the first liquid in the bladder to be accessed through a second pipe located at a second end of the bladder; and wherein the first end is opposite the second end.

16. A method comprising providing a bladder containing a first liquid which substantially fills the bladder;

providing a lid;

providing a container body;

placing the bladder in the container body;

connecting the lid to the container body so that the bladder is enclosed within a combination of the lid and the container body;

wherein the container body is capable of retaining liquid so that if all of the first liquid leaks out of the bladder, all of the first liquid will be retained in the container body;

wherein the container body includes a first hatch door which allows at least some of the first liquid in the bladder to be accessed through a first pipe located at a first end of the bladder;

wherein the container body includes a second hatch door which allows at least some of the first liquid in the bladder to be accessed through a second pipe located at a second end of the bladder; and wherein the first end is opposite the second end; and wherein a first rim is attached to the container body;

wherein the first hatch door can be locked to the first rim or unlocked from the first rim;

wherein the first rim defines a perimeter of a first opening in a first side of the container body;

and further comprising providing a first device which can be attached to the first rim when the first hatch door is open and unlocked from the first rim, and wherein the first device while attached to the first rim can access at least some of the first liquid of the bladder through the first pipe located at the first end of the bladder;

and further wherein a second rim is attached to the container body;

wherein the second hatch door can be locked to the second rim or unlocked from the second rim;

wherein the second rim defines a perimeter of a second opening in a second side of the container body, which is opposite the first side of the container body;

and further comprising providing a second device which can be attached to the second rim when the second hatch door is open and unlocked from the second rim, and wherein the second device while attached to the second rim can access at least some of the first liquid of the bladder through the second pipe located at the second end of the bladder.

17. The method of claim 16 wherein the first liquid is fuel for generating electricity; and further comprising causing the first device to supply at least some of the first liquid from the first end of the bladder to a first generator device for generating electricity.

18. The method of claim 17 wherein the first liquid is fuel for generating electricity; and further comprising causing the first device to supply at least some of the first liquid from the first end of the bladder to a first generator device for generating electricity while at the same time causing the second device to supply the first liquid from the second end of the bladder to a second generator device for generating electricity.

19. The method of claim 1 wherein the container body is constructed to withstand at least a gravitational force.

* * * * *